US005680372A

United States Patent [19]

Flores et al.

[11] Patent Number: 5,680,372

[45] Date of Patent: Oct. 21, 1997

[54] MAGNETIC-BACKED TIME-INDICATING DEVICE

[76] Inventors: Amal Montez Flores; Melissa Kerry Dagodag, both of 2814 Roscomare Rd., Los Angeles, Calif. 90077

[21] Appl. No.: 383,852

[22] Filed: Feb. 6, 1995

[51] Int. Cl.[6] ..... G04B 19/04; G04B 19/00; G04B 37/00

[52] U.S. Cl. ..... 368/80; 368/223; 368/316

[58] Field of Search ..... 368/76, 80, 88, 368/223, 228, 232, 234, 316, 317, 285

[56] References Cited

U.S. PATENT DOCUMENTS

| | | | |
|---|---|---|---|
| 1,624,741 | 4/1927 | Leppke et al. . | |
| 2,761,198 | 9/1956 | Stern | 368/232 |
| 4,287,676 | 9/1981 | Leinhaus | 40/10 R |
| 4,310,908 | 1/1982 | Fuerneisen | 368/88 |
| 4,320,483 | 3/1982 | Vuilleumier | 368/236 |
| 5,375,102 | 12/1994 | Schiavolini | 368/10 |

*Primary Examiner*—Vit W. Miska

[57] ABSTRACT

A timepiece is constructed of a hand assembly (16) including a clock movement (10) and hands (12). A magnet (18) is affixed to the hand assembly (16) so that the hand assembly (16) may be magnetically mounted on a ferrous metal object (28). In another version there is further provided magnetic ornamental indicator(s) (22) which indicate the time. In still another version an ornamental ferrous metal object (24) is provided and attached to the clock movement (10) and hands (12). In this same version the drive shaft (14) extends through the ornamental ferrous metal object (24), and the magnet (18) is also affixed to the hand assembly (16). Also in this version magnetic ornamental indicator(s) (22) may be further provided. Yet another version provides the hand assembly (16) including a clock movement (10) and hands (12) with a non-magnetic adhesive (26) by which the hand assembly (16) affixes to the ferrous metal object (28). In this same version magnetic ornamental indicator(s) (22) may be further provided. In all versions of the timepiece construction an ornamental object (20) may be further provided and attached to the clock movement (10) and hands (12), and the drive shaft (14) may extend through the ornamental object (20).

2 Claims, 6 Drawing Sheets

MAGNETIC-BACKED TIME-INDICATING DEVICE

BACKGROUND

1. Field of Invention

This invention relates generally to timepieces, and more particularly, to such timepieces which indicate the time with parts magnetically mounted on ferrous metal surfaces.

2. Description of Prior Art

Timepieces commonly employ an electromagnetic means for setting time and for regulating the movement of various components. John M. Bergey U.S. Pat. No. 3,782,102 (Jan. 1, 1974) discloses a solid state watch with a magnetic setting. Two setting switches and a demand switch within the casing are operated from outside the watch by permanent magnets. William B. Beebe U.S. Pat. No. 4,723,233 (Feb. 2, 1988) discloses a magnetically controlled arrhythmical pendulum device.

Other timepieces have movable, decorative components. Steve Feher U.S. Pat. No. 5,077,709 (Dec. 31, 1991) discloses a rotating timepiece dial face construction with movable decorative objects.

However, none of the aforementioned U.S. Patents discloses the unique construction and combination of elements of the present invention. While John M. Bergey U.S. Pat. No. 3,782,102 (Jan. 1, 1974) discloses the use of magnets in setting a timepiece, it does not disclose the use of magnets in mounting a timepiece. While William B. Beebe U.S. Pat. No. 4,723,233 (Feb. 2, 1988) discloses the use of magnets in controlling pendulum movement, it does not disclose the use of magnets in mounting a timepiece. In addition, while Steve Feher U.S. Pat. No. 5,077,709 (Dec. 31, 1991) discloses the use of movable decorative objects located within a transparent chamber and a rotating ornamental dial face, the rotating elements of the face of the timepiece are not readily movable or changeable. The objects which are said to be movable are actually stuck within a sealed chamber. In addition, the objects disclosed in Steve Feher U.S. Pat. No. 5,077,709 (Dec. 31, 1991) are limited to minimal movement within the confines of the chamber, and they are not movable as result of magnetic adhesion.

Therefore, an easy and convenient alteration of the timepieces cited in John M. Bergey U.S. Pat. No. 3,782,102 (Jan. 1, 1974), William B. Beebe U.S. Pat. No. 4,723,233 (Feb. 2, 1988) and Steve Feher U.S. Pat. No. 5,077,709 (Dec. 31, 1991) is not possible. The timepieces cited in these aforementioned U.S. patent cannot be readily adjusted to suit varying aesthetic sensibilities. Neither do the timepieces cited in the aforementioned U.S. Patents comprise many timepieces in one because none of the indicators used to mark the time can be physically added or removed altogether by the user of the timepiece. The indicators of the aforementioned U.S. patents remain fixed on the faces of the timepieces, whereas the magnetic indicators used to mark the time in the present invention can be easily added or altogether removed.

Furthermore, the colors and shapes comprising the timepieces disclosed in the aforementioned U.S. patents cannot be easily altered without damage to the timepieces. In the present invention however, the alteration of the colors and shapes of the magnetic indicators can be easily achieved without damage to the timepiece. In the present invention a magnetic indicator of a different color and shape can easily be incorporated into the timepiece by simply placing it on the ferrous surface where the hand assembly is mounted.

In addition, the timepieces disclosed in John M. Bergey U.S. Pat. No. 3,782,102 (Jan. 1, 1974), William B. Beebe U.S. Pat. No. 4,723,233 (Feb. 2, 1988) and Steve Feher U.S. Pat. No. 5,077,709 (Dec. 31, 1991) do not have as full a range of display possibilities as the present invention. The present invention can be displayed on a wall or table, as well as on any ferrous metal surface. By contrast, the timepieces disclosed in these aforementioned U.S. patent have a restricted range of display possibilities since they do not magnetically adhere to any ferrous metal surface.

SUMMARY OF THE INVENTION

It is accordingly a primary aim and object of the present invention, Magnetic-Backed Time Indicating Device, to provide a timepiece with magnetic-backed parts that indicate the time.

In accordance with one embodiment of the present invention, a hand assembly is provided with a magnet by which the hand assembly adheres magnetically to ferrous metal objects. An ornamental metal or non-metal object may be provided and located between the hands and the clock movement. Generally, the drive shaft for the timepiece extends through a central opening in the ornamental metal or non-metal object. The hands mounted thereon are spaced outwardly from the outer surface of the ornamental metal or non-metal object.

The timepiece may also be provided with magnetic indicators that mark the time. These magnetic indicators may be positioned on the ornamental object located between the clock movement and the hands provided that the ornamental object is comprised of ferrous metal. The magnetic indicators may also be positioned upon a different ferrous metal surface distinct from the ornamental object located between the clock movement and the hands.

In accordance with another embodiment of the present invention, the ornamental ferrous metal object located between the clock movement and hands is free-standing. Provided with no magnet in this version, the hand assembly is fixed to the ornamental ferrous metal object through which the drive shaft extends. In this table top version of the timepiece the magnetic indicators that mark the time are positioned on the ornamental ferrous metal object.

In accordance with another embodiment of the present invention, the hand assembly is provided with a non-magnetic adhesive backing which adheres nonmagnetically to ferrous and other surfaces. In addition, magnetic indicators that mark the time are provided. As in the first embodiment of the invention, the entire timepiece may be mounted on a ferrous metal surface, such as a refrigerator or a file cabinet.

DRAWING FIGURES

Figure 1:
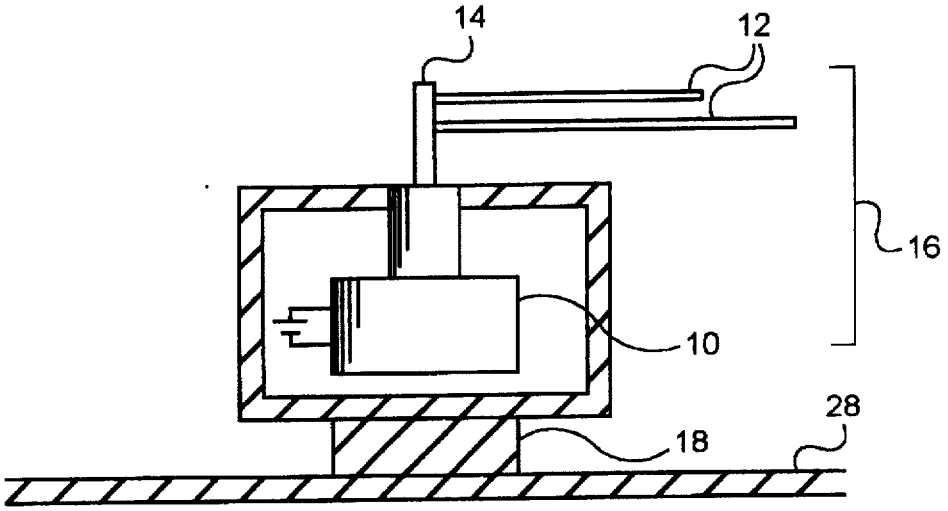
FIGS. 1 to 2 show various aspects of a timepiece including a hand assembly with a magnetic backing.

Reference Numerals in Drawings 10 clock movement
12 hands
14 drive shaft
16 hand assembly
18 magnet
20 ornamental object
22 magnetic ornamental indicator
24 ornamental ferrous metal object
26 non-magnetic adhesive
28 ferrous metal object

DESCRIPTION

FIGS. 1 through 12

Figure 2:
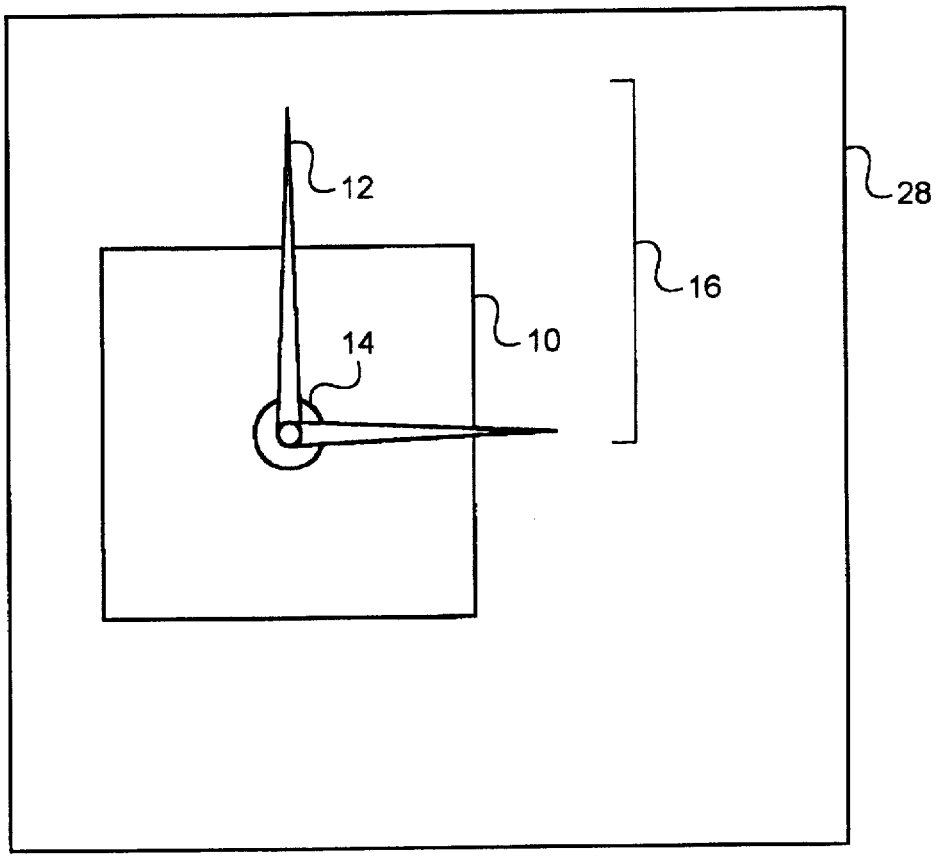

With reference now to the drawings and particularly FIG. 1, a sectional view of a timepiece is shown with a hand assembly 16, including the clock movement 10, hands 12 and drive shaft 14, having a magnet 18 attached. FIG. 2 shows a frontal view of this timepiece. The magnetic mounting of the timepiece to a ferrous metal object 28, such as a refrigerator or a file cabinet, is achieved without interfering with the normal operation of the timepiece.

Figure 3:
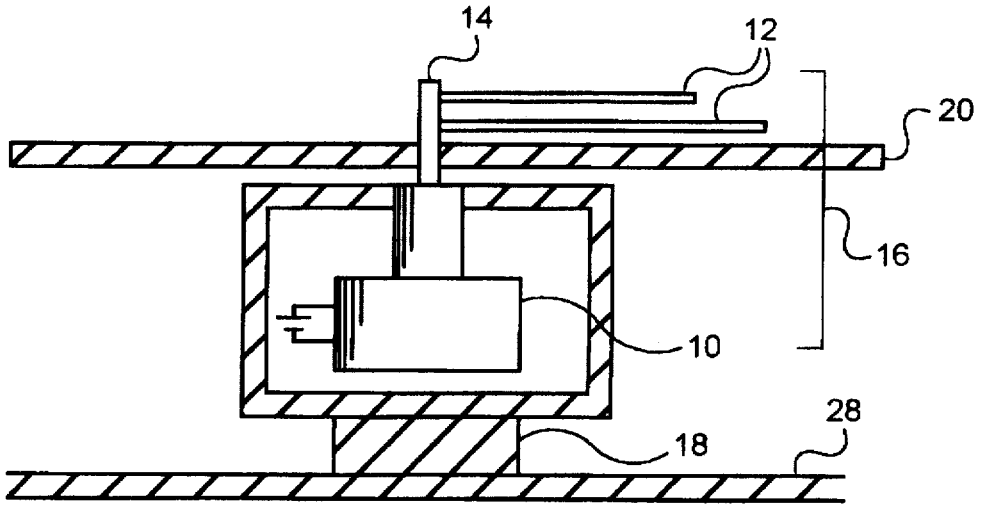
FIGS. 3 to 4 show various aspects of a similar timepiece with an ornamental ferrous metal or non-metal object through which a drive shaft extends with hands located thereupon.
Figure 4:
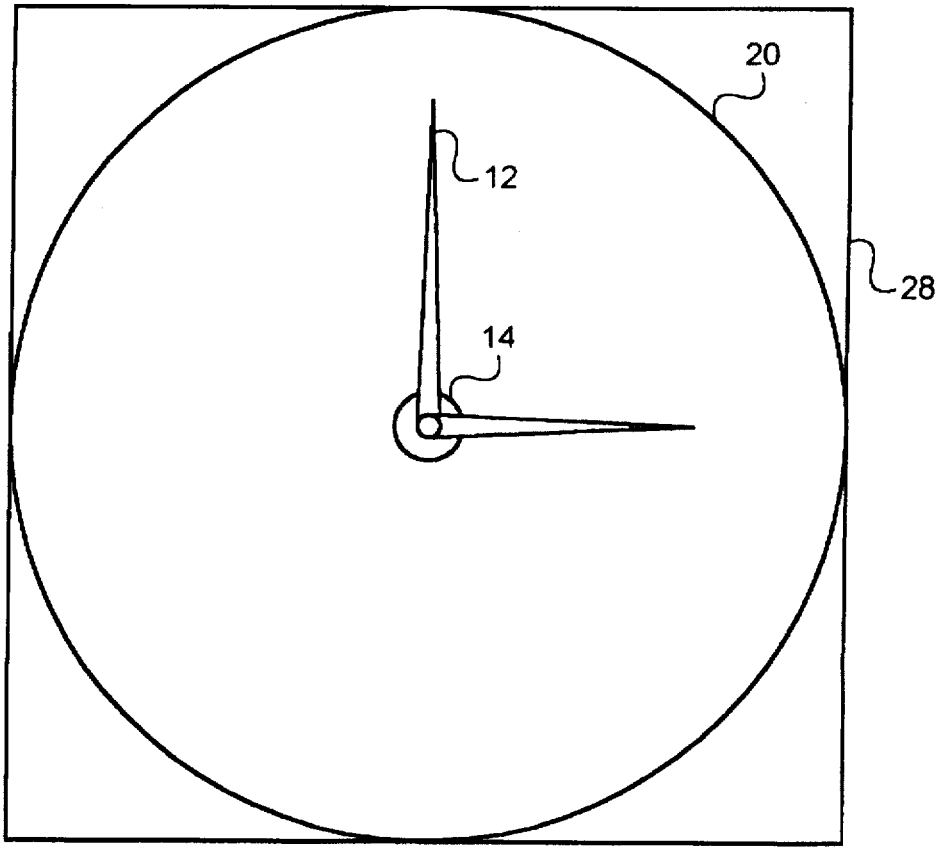

As can be seen in FIGS. 3 and 4 the clock movement 10 and hands 12 may be attached to an ornamental object 20, metal or non-metal, through which the drive shaft 14 extends with the hands 12 located thereon. The hands 12 located thereon may be spaced outwardly from the outer surface of the ornamental object 20.

Figure 5:
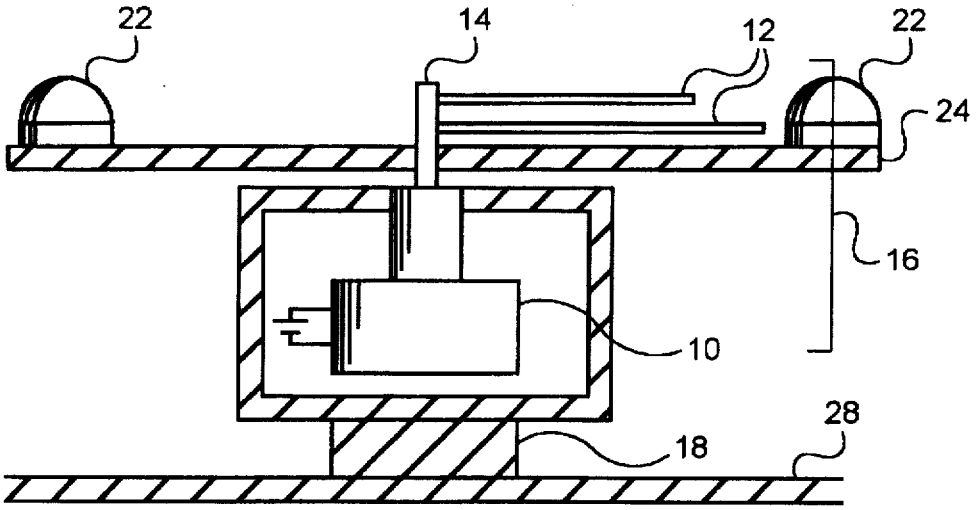
FIGS. 5 to 6 show a similar timepiece with a ferrous metal object through which a drive shaft extends with hands located thereon and upon which magnetic ornamental hour indicators are located.
Figure 6:
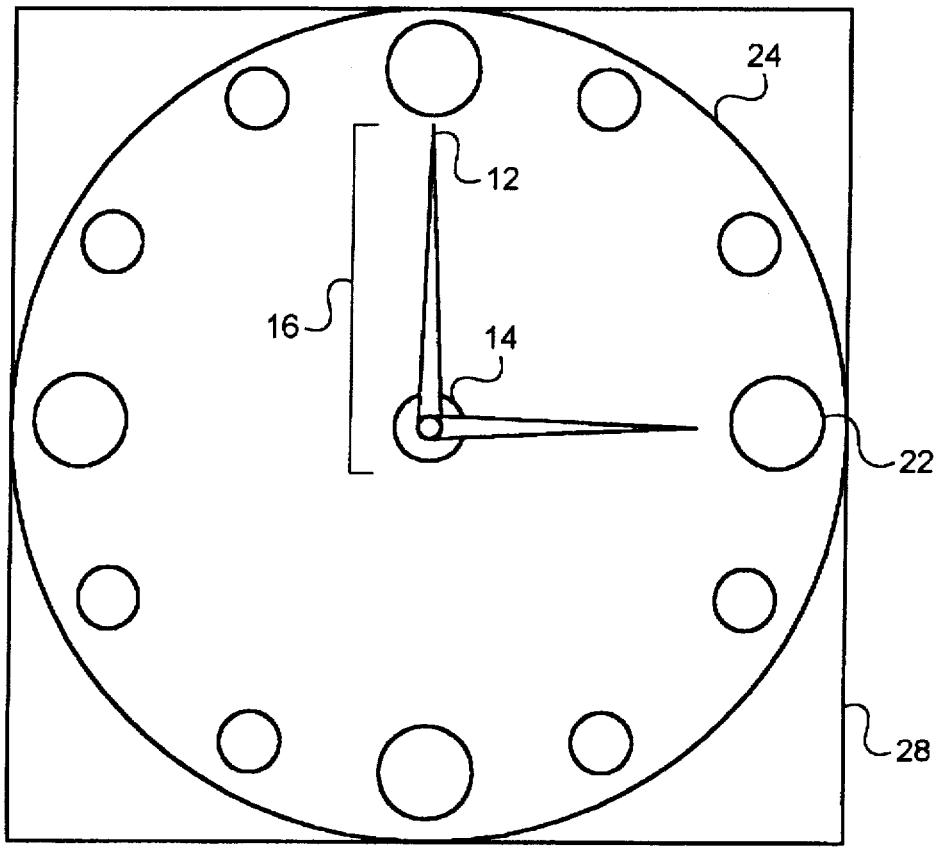

The timepiece of FIGS. 5 and 6 includes not only a clock movement 10, hands 12, drive shaft 14, magnet 18, and ornamental ferrous metal object 24, but also magnetic ornamental indicator(s) 22. The(se) magnetic ornamental indicator(s) 22 may be constructed of any solid material which is either a magnet in and of itself or to which a magnet can be affixed, thereby rendering the ornamental indicators magnetic. In this version of the timepiece the magnetic ornamental indicator(s) 22 may be positioned on the ornamental ferrous metal object 24 to which the hand assembly 16 is affixed and through which the drive shaft 14 extends.

Figure 7:
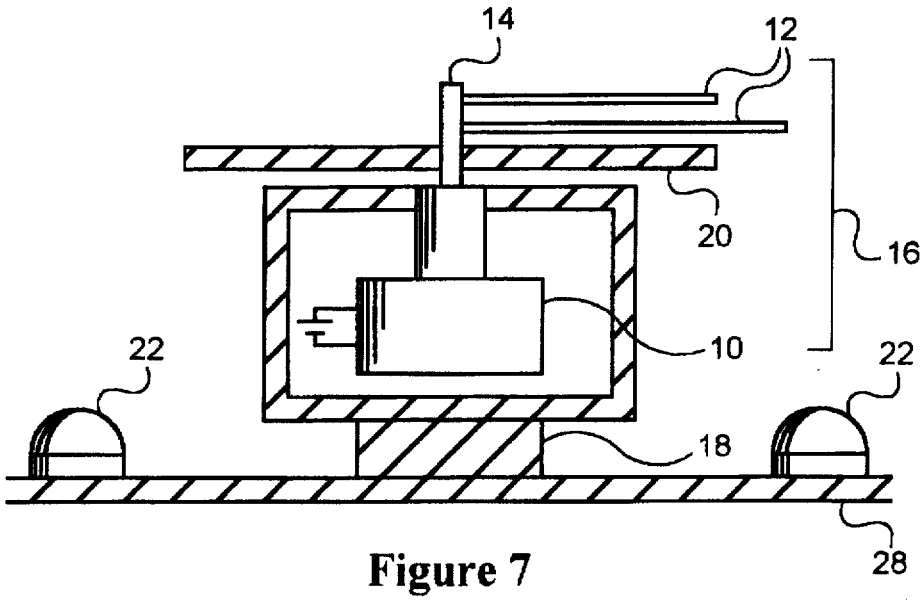
FIGS. 7 to 8 show various aspects of a timepiece including a hand assembly with a magnetic backing and magnetic ornamental hour indicators all of which are positioned on a ferrous metal object.
Figure 8:
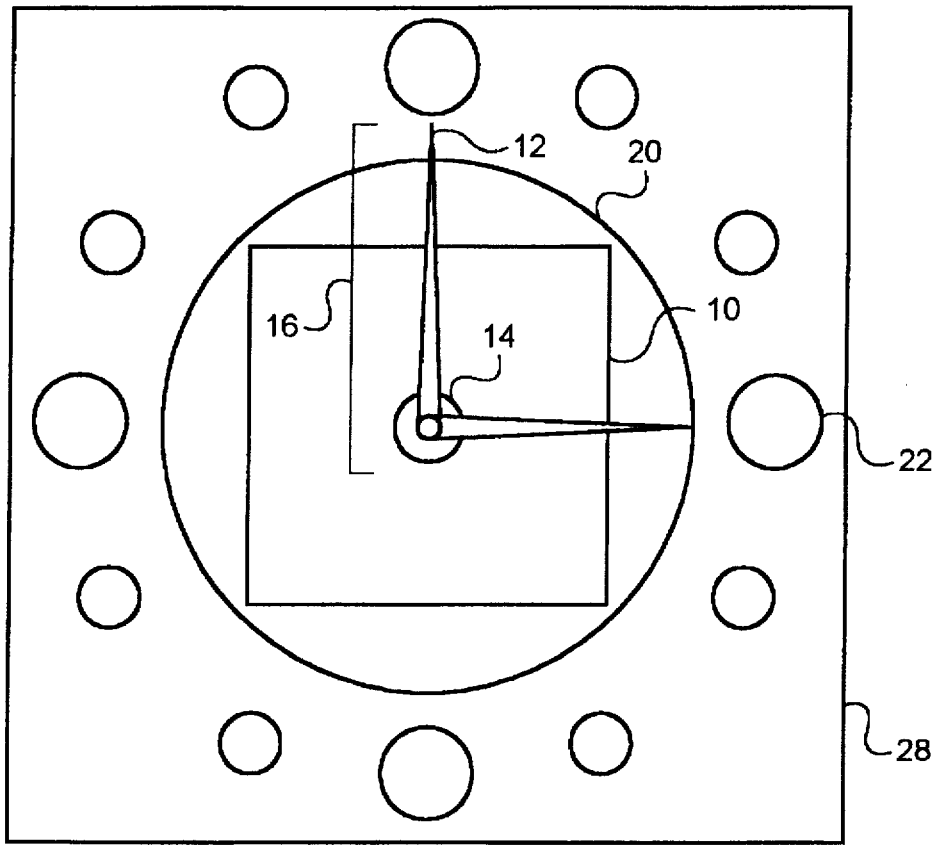

Optionally, the timepiece of FIGS. 7 and 8 may be constructed with or without an ornamental object 20 through which the drive shaft 14 extends. The timepiece is constructed so that the hand assembly 16 and affixed magnet 18 may be positioned on a ferrous metal object 28, such as a refrigerator. The magnetic ornamental indicator(s) 22 may also be positioned on the ferrous metal object 28 in peripheral pattern surrounding the hand assembly 16 and affixed magnet 18.

Figure 9:
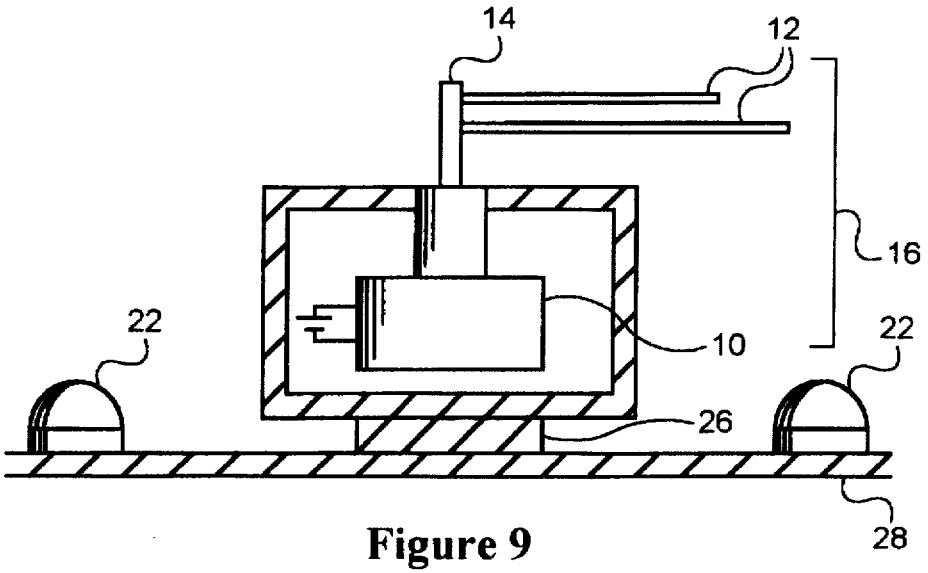
FIGS. 9 to 10 show various aspects of a timepiece including a hand assembly with a non-magnetic adhesive backing and magnetic ornamental hour indicators all of which are positioned on a ferrous metal object.
Figure 10:
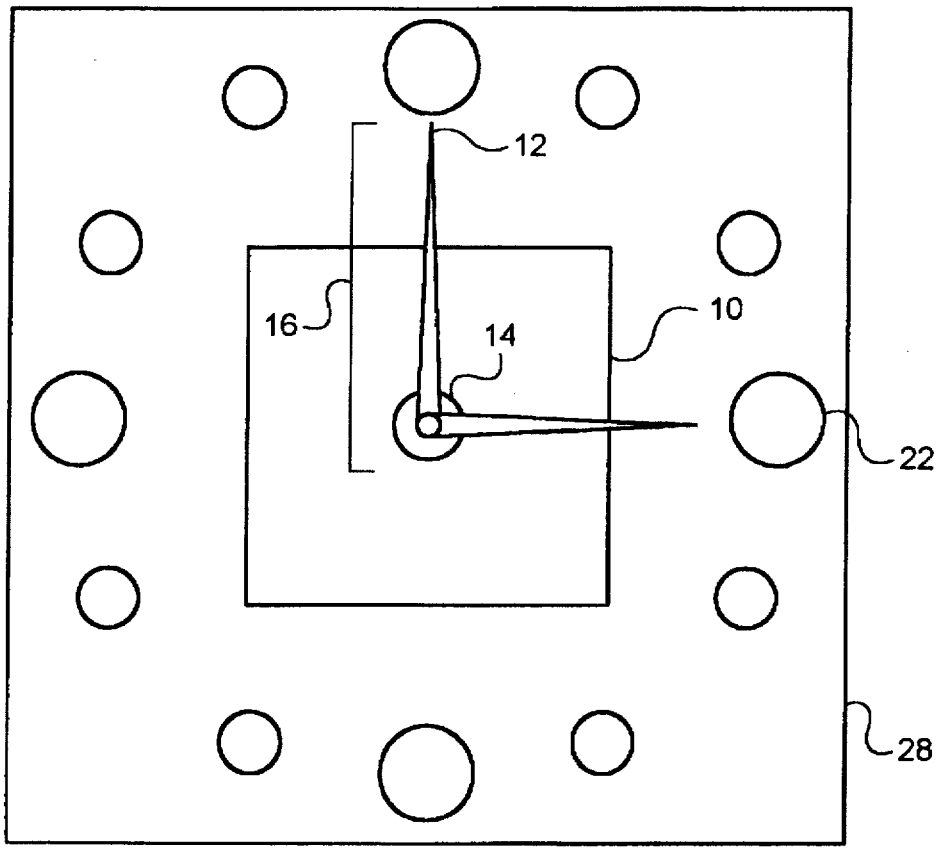

As can be seen in FIGS. 9 to 10 in a different version the timepiece may be constructed of a hand assembly 16 with a backing of a non-magnetic adhesive 26. The magnetic ornamental indicator(s) 22 and the hand assembly 16 with a backing of non-magnetic adhesive 26 may be positioned on a ferrous metal object 28. The hand assembly 16 of this version of the timepiece therefore adheres to the ferrous metal object 28 non-magnetically, while the ornamental magnetic indicators 22 adhere magnetically.

Figure 11:
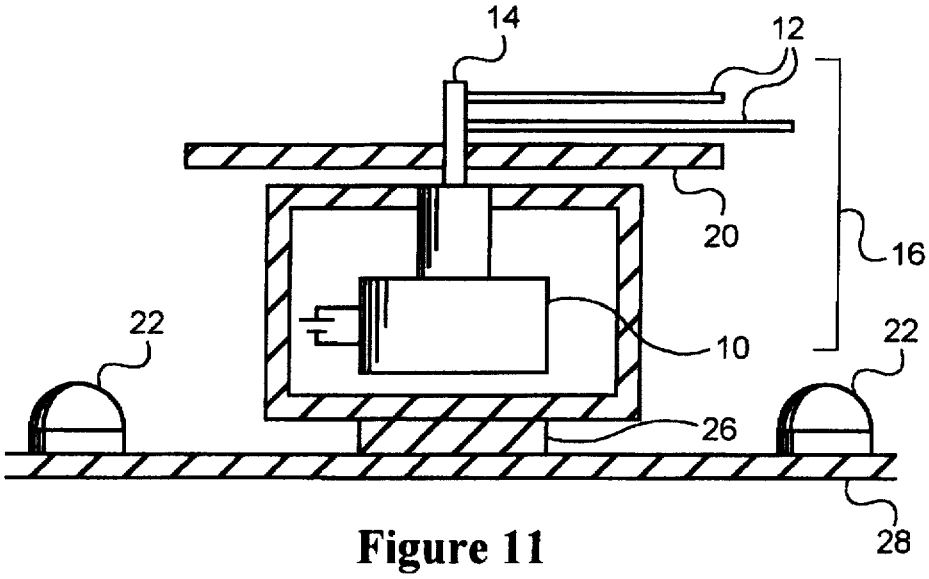
FIGS. 11 to 12 show various aspects of a similar timepiece with an ornamental object through which the drive shaft extends with hands located thereupon.
Figure 12:
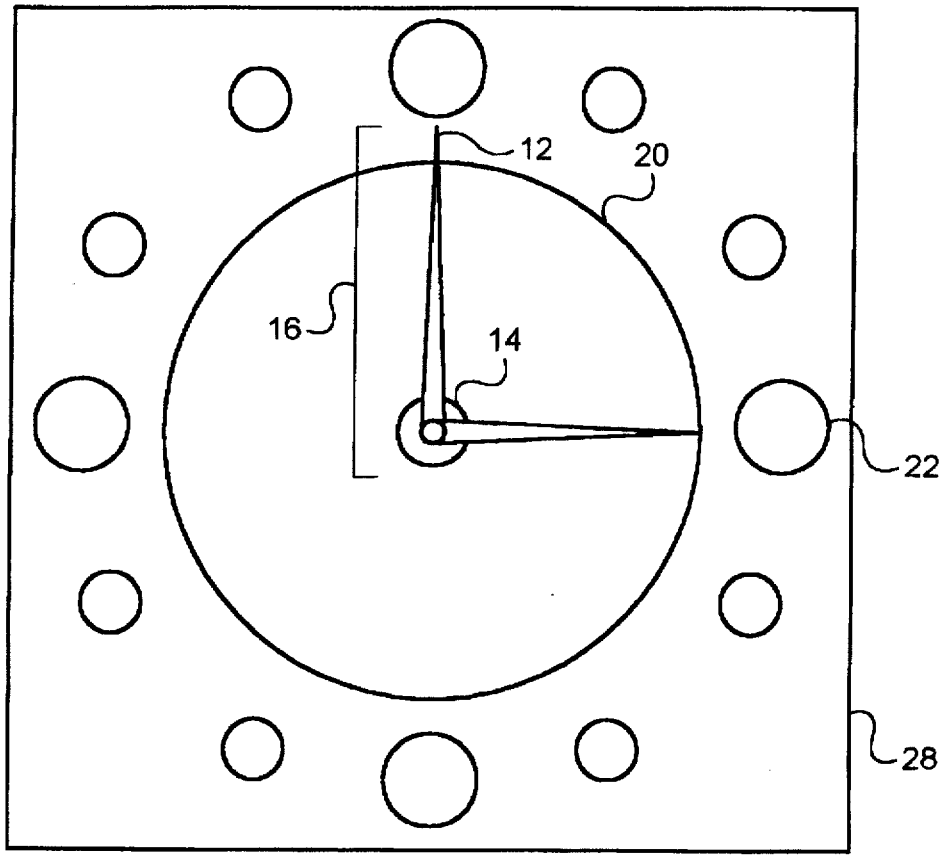

In FIGS. 11 to 12 a similar timepiece to FIGS. 9 to 10 is constructed with the addition of an ornamental object 20, metal or non-metal, through which the drive shaft 14 extends with the hands 12 located thereon.

Although the description above contains some specificities, these should not be construed as limiting the scope of the invention, but as merely providing illustrations of some of the presently preferred embodiments of this invention. For example, the timepiece may have a vast variety of magnetic ornamental indicators constructed of plastic, wood or other materials, but it does not need to have any magnetic ornamental indicators at all. The hand assembly may simply have a magnetic backing without any inclusive magnetic ornamental indicators that mark the time. The magnetic-backed hand assembly may be mounted alone or in conjunction with magnetic ornamental indicators. Also, the ornamental object located between the hand assembly and hands and through which the drive shaft extends is not limited in shape or size. Thus, the scope of this invention should be determined by the appended claims and their legal equivalents, rather than by the examples given.

We claim:

1. A timepiece construction comprising:

a hand assembly including a clock movement; drive shaft and hands, a magnet for affixing said hand assembly to a ferrous metal surface; and at least one movable magnetic ornamental indicator means attached to said ferrous metal surface and positioned proximately to said hand assembly for marking time, thereby allowing the size of said timepiece construction to be easily changed.

2. A timepiece construction comprising:

a hand assembly including a clock movement, drive shaft and hands;

a magnet for affixing said hand assembly to a ferrous metal surface;

at least one movable magnetic ornamental indicator means attached to said ferrous metal surface and positioned proximately to said hand assembly for marking time, thereby allowing the size of said timepiece construction to be easily changed; and an ornamental object for concealing at least a part of said hand assembly, said clock movement and said hands being attached to and said drive shaft being extended through said ornamental object.

* * * * *